US008178269B2

(12) United States Patent
Zhou et al.

(10) Patent No.: US 8,178,269 B2
(45) Date of Patent: May 15, 2012

(54) TONER COMPOSITIONS AND METHODS

(75) Inventors: Ke Zhou, Oakville (CA); Guerino G. Sacripante, Mississauga (CA); Paul Joseph Gerroir, Oakville (CA); Edward Graham Zwartz, Mississauga (CA); Michael S. Hawkins, Cambridge (CA)

(73) Assignee: Xerox Corporation, Norwalk, CT (US)

( * ) Notice: Subject to any disclaimer, the term of this patent is extended or adjusted under 35 U.S.C. 154(b) by 237 days.

(21) Appl. No.: 12/718,592

(22) Filed: Mar. 5, 2010

(65) Prior Publication Data

US 2011/0217648 A1 Sep. 8, 2011

(51) Int. Cl.
*G03G 9/08* (2006.01)

(52) U.S. Cl. ..... 430/108.1; 430/108.4

(58) Field of Classification Search ..... 430/108.1, 430/108.4

See application file for complete search history.

(56) References Cited

U.S. PATENT DOCUMENTS

| | | | |
|---|---|---|---|
| 3,556,998 | A | 1/1971 | Steiner |
| 5,278,020 | A | 1/1994 | Grushkin |
| 5,290,654 | A | 3/1994 | Sacripante et al. |
| 5,308,734 | A | 5/1994 | Sacripante et al. |
| 5,344,738 | A | 9/1994 | Kmiecik-Lawrynowicz et al. |
| 5,346,797 | A | 9/1994 | Kmiecik-Lawrynowicz et al. |
| 5,348,832 | A | 9/1994 | Sacripante et al. |
| 5,364,729 | A | 11/1994 | Kmiecik-Lawrynowicz et al. |
| 5,366,841 | A | 11/1994 | Patel et al. |
| 5,370,963 | A | 12/1994 | Patel et al. |
| 5,403,693 | A | 4/1995 | Patel et al. |
| 5,405,728 | A | 4/1995 | Hopper et al. |
| 5,418,108 | A | 5/1995 | Kmiecik-Lawrynowicz et al. |
| 5,496,676 | A | 3/1996 | Croucher et al. |
| 5,501,935 | A | 3/1996 | Patel et al. |
| 5,527,658 | A | 6/1996 | Hopper et al. |
| 5,585,215 | A | 12/1996 | Ong et al. |
| 5,650,255 | A | 7/1997 | Ng et al. |
| 5,650,256 | A | 7/1997 | Veregin et al. |
| 5,723,253 | A | 3/1998 | Higashino et al. |
| 5,744,520 | A | 4/1998 | Kmiecik-Lawrynowicz et al. |
| 5,747,215 | A | 5/1998 | Ong et al. |
| 5,763,133 | A | 6/1998 | Ong et al. |
| 5,766,818 | A | 6/1998 | Smith et al. |
| 5,804,349 | A | 9/1998 | Ong et al. |
| 5,827,633 | A | 10/1998 | Ong et al. |
| 5,840,462 | A | 11/1998 | Foucher et al. |
| 5,853,943 | A | 12/1998 | Cheng et al. |
| 5,853,944 | A | 12/1998 | Foucher et al. |
| 5,863,698 | A | 1/1999 | Patel et al. |
| 5,869,215 | A | 2/1999 | Ong et al. |
| 5,902,710 | A | 5/1999 | Ong et al. |

(Continued)

FOREIGN PATENT DOCUMENTS

| | | |
|---|---|---|
| EP | 1 126 327 | 8/2001 |

(Continued)

OTHER PUBLICATIONS

Abstract of JP 2002174925, Jun. 2002.*

(Continued)

*Primary Examiner* — Hoa V Le
(74) *Attorney, Agent, or Firm* — Oliff & Berridge, PLC

(57) ABSTRACT

Emulsion aggregation toner particles including a resin, polysaccharide particles, an optional wax, and an optional colorant. The toner particles contain about 1 to about 50 wt % polysaccharide particles based on the total weight of the toner particles.

20 Claims, 3 Drawing Sheets

U.S. PATENT DOCUMENTS

| | | | |
|---|---|---|---|
| 5,910,387 | A | 6/1999 | Mychajlowskij et al. |
| 5,916,725 | A | 6/1999 | Patel et al. |
| 5,919,595 | A | 7/1999 | Mychajlowskij et al. |
| 5,922,501 | A | 7/1999 | Cheng et al. |
| 5,925,488 | A | 7/1999 | Patel et al. |
| 5,928,829 | A | 7/1999 | Cheng et al. |
| 5,977,210 | A | 11/1999 | Patel et al. |
| 6,063,827 | A | 5/2000 | Sacripante et al. |
| 6,413,690 | B2 | 7/2002 | Tomita |
| 6,576,389 | B2 | 6/2003 | Vanbesien et al. |
| 6,593,049 | B1 | 7/2003 | Veregin et al. |
| 6,617,092 | B1 | 9/2003 | Patel et al. |
| 6,627,373 | B1 | 9/2003 | Patel et al. |
| 6,638,677 | B2 | 10/2003 | Patel et al. |
| 6,656,657 | B2 | 12/2003 | Patel et al. |
| 6,656,658 | B2 | 12/2003 | Patel et al. |
| 6,664,017 | B1 | 12/2003 | Patel et al. |
| 6,673,505 | B2 | 1/2004 | Jiang et al. |
| 6,730,450 | B1 | 5/2004 | Moffat et al. |
| 6,743,559 | B2 | 6/2004 | Combes et al. |
| 6,756,176 | B2 | 6/2004 | Stegamat et al. |
| 6,780,500 | B2 | 8/2004 | Dumouchel |
| 6,830,860 | B2 | 12/2004 | Sacripante et al. |
| 7,029,817 | B2 | 4/2006 | Robinson et al. |
| 7,235,337 | B2 | 6/2007 | Kameyama et al. |
| 7,329,476 | B2 | 2/2008 | Sacripante et al. |
| 7,510,811 | B2 | 3/2009 | Matsumura et al. |
| 2005/0112491 | A1 | 5/2005 | Choi |
| 2006/0223934 | A1 | 10/2006 | Chen et al. |
| 2008/0107989 | A1 | 5/2008 | Sacripante et al. |
| 2008/0199797 | A1 | 8/2008 | Sacripante et al. |
| 2008/0236446 | A1 | 10/2008 | Zhou et al. |
| 2009/0245876 | A1 | 10/2009 | Tohata et al. |
| 2010/0087552 | A1* | 4/2010 | Shiomi et al. ..... 516/9 |
| 2011/0076610 | A1 | 3/2011 | Ogawa et al. |

FOREIGN PATENT DOCUMENTS

| | | | |
|---|---|---|---|
| GB | 1442835 | | 7/1976 |
| JP | 2002174925 | * | 6/2002 |
| JP | A 2002-174925 | | 6/2002 |
| WO | WO 2010/077012 | | 7/2010 |

OTHER PUBLICATIONS

Search Report mailed Jun. 15, 2011 in corresponding GB Patent Application No. GB 1102954.3.

Huebner et al., "Preparation of Cellodextrins: An Engineering Approach," Biotechnology and Bioengineering, vol. 20, No. 10, pp. 1669-1677, 1978.

Zhang et al., "Cellodextrin Preparation by Mixed-Acids Hydrolysis and Chromatographic Separation," Analytical Biochemistry, vol. 322, pp. 225-232, 2003.

Hiraishi et al., "Synthesis of Highly Ordered Cellulose II in Vitro Using Cellodextrin Phosphorylase," Carbohydrate Research, vol. 344, pp. 2468-2473, 2009.

* cited by examiner

TONER COMPOSITIONS AND METHODS

TECHNICAL FIELD

This disclosure is generally directed to chemical toner compositions. More specifically, this disclosure is directed to emulsion aggregation toner compositions that contain polysaccharides, emulsion aggregation methods of making such toner compositions, and methods of forming images with such toner compositions.

BACKGROUND

Conventional toners are produced by grinding a composite block to form toner particles. The grinding process has a high energy consumption and results in particles with high coarse content and irregular shape and size distributions. As such, conventional toner particles must be sorted to eliminate undesirable particles.

Typically, resins used in chemical toners for imaging are petroleum-based. The use of petroleum-based materials leads to an increased release of greenhouse gases and accumulation of non-degradable materials in the environment. In addition, some petroleum-based resins have been identified as toxic. For example resins derived from the Bisphenol A monomer are commonly used in toner compositions. Bisphenol A has been identified as a carcinogen and endocrine disrupter resulting in adverse developmental effects in mice. Its use in drinking bottles and microwave ware is suspected to be harmful. In fact, several European Countries, as well as Canada and several U.S. states are targeting the ban of this chemical.

Bio-based resins have attracted interest as an alternative to petroleum-based polymeric materials. Bio-based resins are derived from renewable plant materials and generally do not contain environmentally damaging or toxic substances. By using bio-based products, reliance on petroleum resources is diminished. Thus, bio-based resins may serve as a viable replacement for some petroleum-based resins due to their properties and environmental acceptability.

U.S. Pat. No. 6,413,690 to Tomita describes a conventional toner that includes as components a coloring agent and a binder, the binder including a wax and ethyl polysaccharide (ethyl etherified D-glucose). Although this process uses a polysaccharide, it fails to do so in a energy efficient process that results in low coarse content and with desirable particle shape and size distributions.

Thus, there is a need for alternative, sustainable, environmentally friendly, and non-toxic materials for use in toner particles that can be used in energy efficient processes for making toner particles with desirable particle characteristics.

SUMMARY

Exemplary toners provide superior print quality while meeting requirements of typical printing processes. The present disclosure in embodiments addresses these various needs and problems by providing emulsion aggregation toner particles that include polysaccharides as fillers to increase the bio-content and reduce the petroleum-base content in toner compositions. The toner particles comprise a resin, a polysaccharide, an optional wax, and an optional colorant.

Embodiments also include methods for making such toner particles and methods of forming images with such toners.

These and other improvements are accomplished by the compositions and methods described in embodiments herein.

EMBODIMENTS

Figure 1:
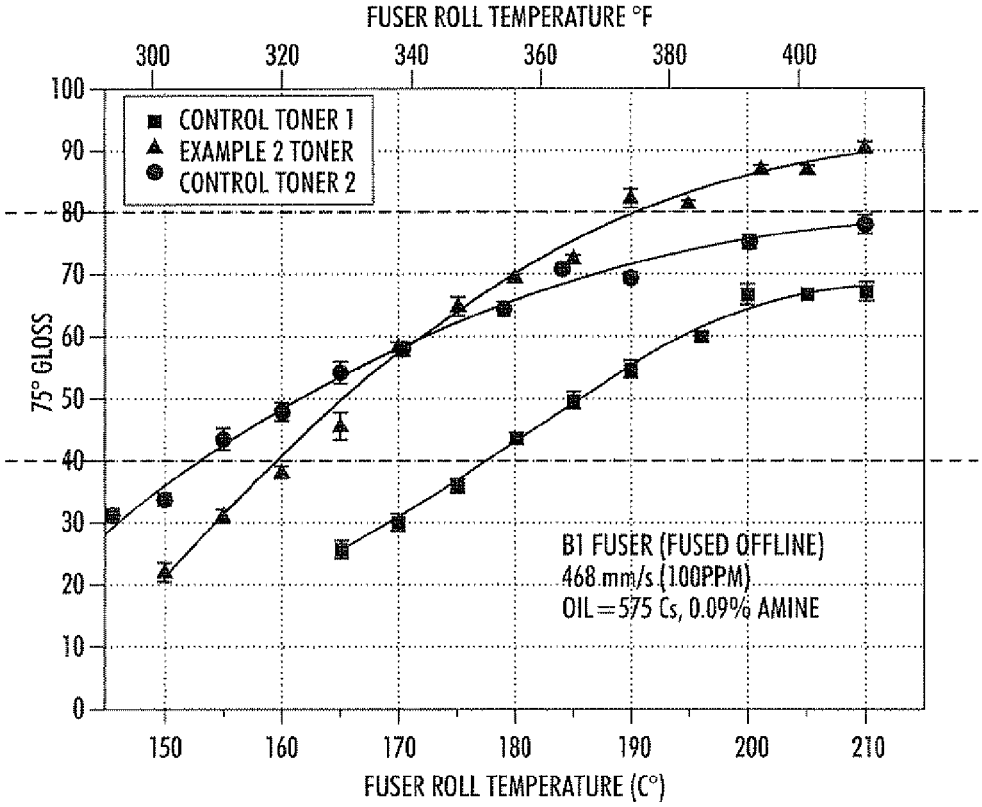
FIG. 1 is a graph of the fusing evaluation of two control toners and the toner of Example 2.

This disclosure is not limited to particular embodiments described herein, and some components and processes may be varied by one of ordinary skill, based on this disclosure.

In this specification and the claims that follow, singular forms such as "a," "an," and "the" include plural forms unless the content clearly dictates otherwise. All ranges disclosed herein include, unless specifically indicated, all endpoints and intermediate values. In addition, reference may be made to a number of terms that shall be defined as follows:

The term "functional group" refers, for example, to a group of atoms arranged in a way that determines the chemical properties of the group and the molecule to which it is attached. Examples of functional groups include halogen atoms, hydroxyl groups, carboxylic acid groups, and the like.

"Optional" or "optionally" refer, for example, to instances in which subsequently described circumstance may or may not occur, and include instances in which the circumstance occurs and instances in which the circumstance does not occur.

The terms "one or more" and "at least one" refer, for example, to instances in which one of the subsequently described circumstances occurs, and to instances in which more than one of the subsequently described circumstances occurs.

Resins and Polymers

Various toners, such as styrene acrylate toners, UV curable toners, and polyester toners, may be made that incorporate a polysaccharide bio-content. Thus, the emulsion aggregation toner particles include at least one resin or a mixture of two or more resins, for example, the toner particles may include a styrene resin, a UV curable resin, and/or a polyester resin.

Styrene resins and polymers are known in the art. Suitable styrene resins include, for example, styrene-based monomers, including styrene acrylate-based monomers. Illustrative examples of such resins may be found, for example, in U.S. Pat. Nos. 5,853,943; 5,922,501; and 5,928,829, the entire disclosures thereof being incorporated herein by reference.

Specific examples include poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), polyethyl acrylate-isoprene), poly(propyl acrylate-isoprene), poly(butyl acrylate-isoprene), poly(styrene-propyl acrylate), poly(styrene-butyl acrylate), poly(styrene-butadiene-acrylic acid), poly(styrene-butadiene-methacrylic acid), polystyrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), and poly(styrene-butyl acrylate-acrylonitrile-acrylic acid), and combinations thereof. The polymer may be block, random, or alternating copolymers.

UV curable resins are known in the art. UV curable resins may be unsaturated polymers that can be crosslinked in the presence of activating radiation such as ultraviolet light and a suitable photo initiator. Illustrative examples of such resins may be found, for example, in U.S. Patent Application Publication No. 2008-0199797, the entire disclosure thereof being incorporated herein by reference.

Polyester resins are also known in the art. The specific polyester resin or resins selected for the present disclosure include, for example, unsaturated polyester and/or its derivatives, polyimide resins, branched polyimide resins, and any of the various polyesters, such as crystalline polyesters, amorphous polyesters, or a mixture thereof. Thus, for example, the toner particles can be comprised of crystalline polyester resins, amorphous polyester resins, or a mixture of two or more polyester resins where one or more polyester is crystalline and one or more polyester is amorphous. Illustrative examples of such resins may be found, for example, in U.S. Pat. Nos. 6,593,049, 6,756,176, and 6,830,860, the entire disclosures thereof being incorporated herein by reference.

The resin may be a polyester resin formed by reacting a diol with a diacid in the presence of a catalyst. For forming a crystalline polyester, suitable organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, ethylene glycol, combinations thereof, and the like. The aliphatic diol may be, for example, selected in an amount of from about 40 to about 60 mol %, such as from about 42 to about 55 mol %, or from about 45 to about 53 mol % of the resin.

Examples of organic diacids or diesters selected for the preparation of the crystalline resins include oxalic acid, succinic acid, glutaric acid, adipic acid, suberic acid, azelaic acid, fumaric acid, maleic acid, dodecanedioic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof, and combinations thereof. The organic diacid may be selected in an amount of, for example, from about 40 to about 60 mol %, such as from about 42 to about 55 mol %, or from about 45 to about 53 mol %.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), polybutylene-adipate), poly(pentylene-adipate), poly (hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), alkali copoly(5-sulfoisophthaloyl)-copoly(ethylene-adipate), poly(decylene-sebacate), poly(decylene-decanoate), poly-(ethylene-decanoate), poly-(ethylene-dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), and copoly (ethylene-fumarate)-copoly(ethylene-dodecanoate), and combinations thereof.

The crystalline resin may be present, for example, in an amount of from about 3 to about 50 wt % of the toner components, such as from about 15 to about 35 wt % of the toner components. The crystalline resin can possess various melting points of, for example, from about 30° C. to about 120° C., such as from about 50° C. to about 90° C. The crystalline resin may have a number average molecular weight ($M_n$), as measured by gel permeation chromatography (GPC) of, for example, from about 1,000 to about 50,000, such as from about 2,000 to about 25,000, and a weight average molecular weight ($M_w$) of, for example, from about 2,000 to about 100,000, such as from about 3,000 to about 80,000, as determined by GPC using polystyrene standards. The molecular weight distribution ($M_w/M_n$) of the crystalline resin may be, for example, from about 2 to about 6, such as from about 3 to about 4.

Examples of diacid or diesters selected for the preparation of amorphous polyesters include dicarboxylic acids or diesters such as terephthalic acid, phthalic acid, isophthalic acid, fumaric acid, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, dimethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The organic diacid or diester may be present, for example, in an amount from about 40 to about 60 mol % of the resin, such as from about 42 to about 55 mol % of the resin, or from about 45 to about 53 mol % of the resin.

Examples of diols used in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis (hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis(2-hydroxyethyl)oxide, dipropylene glycol, dibutylene, and combinations thereof. The amount of organic diol selected can vary, and may be present, for example, in an amount from about 40 to about 60 mol % of the resin, such as from about 42 to about 55 mol % of the resin, or from about 45 to about 53 mol % of the resin.

Polycondensation catalysts that may be used for either the crystalline or amorphous polyesters include tetraalkyl titanates such as titanium (iv) butoxide or titanium (iv) iso-propoxide, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be used in amounts of, for example, from about 0.001 mol % to about 0.55 mol % based on the starting diacid or diester used to generate the polyester resin.

Suitable amorphous resins include polyesters, polyamides, polyimides, polyolefins, polyethylene, polybutylene, polyisobutyrate, ethylene-propylene copolymers, ethylene-vinyl acetate copolymers, polypropylene, combinations thereof, and the like. Examples of amorphous resins include poly (styrene-acrylate) resins, crosslinked, for example, from about 10% to about 70%, poly(styrene-acrylate) resins, poly (styrene-methacrylate) resins, crosslinked poly(styrene-methacrylate) resins, poly(styrene-butadiene) resins, crosslinked poly(styrene-butadiene) resins, alkali sulfonated-polyester resins, branched alkali sulfonated-polyester resins, alkali sulfonated-polyimide resins, branched alkali sulfonated-polyimide resins, alkali sulfonated poly(styrene-acrylate) resins, crosslinked alkali sulfonated poly(styrene-acrylate) resins, poly(styrene-methacrylate) resins, crosslinked alkali sulfonated-poly(styrene-methacrylate) resins, alkali sulfonated-poly(styrene-butadiene) resins, and crosslinked alkali sulfonated poly(styrene-butadiene) resins. Alkali sulfonated polyester resins may be used, such as the metal or alkali salts of copoly(ethylene-terephthalate)-copoly(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfoisophthalate), copoly(propylene-butylene-terephthalate)-copoly(propylene-butylene-5-sulfo-isophthalate), and copoly(propoxylated bisphenol-A-fumarate)-copoly(propoxylated bisphenol A-5-sulfo-isophthalate).

Examples of other suitable latex resins or polymers include poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), poly(styrene-butyl acrylate-acrylonitrile-acrylic acid), and combinations thereof. The polymers may be block, random, or alternating copolymers.

An unsaturated polyester resin may be used as a latex resin. Examples of such resins include those disclosed in U.S. Pat. No. 6,063,827, the disclosure of which is hereby incorporated by reference in its entirety. Exemplary unsaturated polyester resins include poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof.

A suitable amorphous polyester resin may be a poly(propoxylated bisphenol A co-fumarate) resin having the following formula (I):

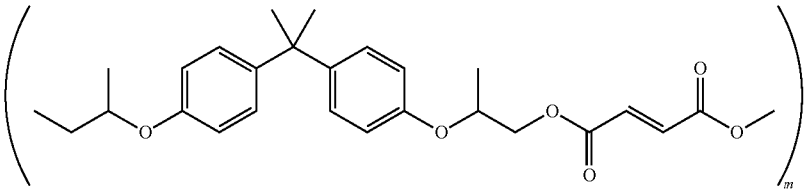

where m may be from about 5 to about 1000.

An example of a linear propoxylated bisphenol A fumarate resin which may be used as a latex resin is available under the trade name SPARII from Resana S/A Industrias Quimicas, Sao Paulo Brazil. Other commercially available propoxylated bisphenol A fumarate resins include GTUF and FPESL-2 from Kao Corporation, Japan, and EM181635 from Reichhold, Research Triangle Park, N.C., and the like. Other suitable amorphous resins include those disclosed in U.S. Pat. No. 7,235,337, the entire disclosure of which is incorporated herein by reference.

Suitable crystalline resins include those disclosed in U.S. Pat. Nos. 7,329,476 and 7,510,811, the disclosures of which are hereby incorporated by reference in their entirety. The crystalline resin may be composed of ethylene glycol and a mixture of dodecanedioic acid and fumaric acid co-monomers with the following formula:

(II)

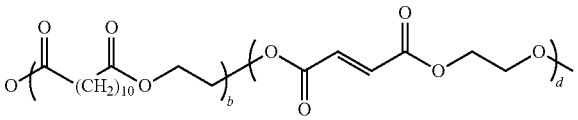

where b is from about 5 to about 2000 and d is from about 5 to about 2000.

One, two, or more toner resins/polymers may be used. In embodiments where two or more toner resins are used, the toner resins may be in any suitable ratio (e.g., weight ratio) such as, for instance, about 10% first resin:90% second resin to about 90% first resin:10% second resin. The amorphous resin used in the core may be linear.

The resin may be formed by emulsion polymerization methods, or may be a pre-made resin.

Polysaccharides

In embodiments, the emulsion aggregation toner particles include at least one polysaccharide or a mixture of two or more polysaccharides. The polysaccharide serves as a filler material to take the place of conventional petroleum-based materials. It may be uniformly distributed throughout the emulsion aggregation toner particle, as opposed to serving as a surface modifier.

Any polysaccharide that may be emulsified and integrated with the emulsion aggregation toner components may be used, such as, for example, nano-sized polysaccharide particles. "Nano-sized" polysaccharide particles include polysaccharides in particle form having an average particle size of from about 10 nm to about 500 nm, such as from about 20 nm to about 200 nm, from about 50 nm to about 200 nm, from about 75 nm to about 150 nm, from about 125 nm to about 225 nm, or from about 150 nm to about 200 nm.

Suitable polysaccharides include those having long-chain structures and good mechanical properties, such as homopolysaccharides and heteropolysaccharides that comprise 9 or more monosaccharides, such as from about 9 to about 3000, from about 40 to about 300, or from about 200 to about 2500. The monosaccharides are linked together by, for example, glycosidic bonds. The monosaccharides may have from about 3 to about 9 carbon atoms in the ring structure and may include functional groups. Exemplary monosaccharides include erythrose, threose, ribose, arabinose, xylose, lyxose, allose, altrose, glucose, mannose, gulose, idose, galactose, talose, fructose, and tagatose. Exemplary polysaccharides include starches, cellulose, chitin, glycogen, cellodextrins, partially de-polymerized polysaccharide, microcrystalline cellulose, and combinations thereof.

Suitable cellodextrines may be used as the polysaccharide. Cellodextrins are created through the cleavage of cellulose in most anaerobic bacteria by the cellulosome (an amalgamation of cellulolytic enzymes on the outside of a cell). First, an endoglucanase cuts the crystalline cellulose in an amorphous zone and, subsequently, exoglucanases cleave the large insoluble chunks of cellulose into smaller, soluble cellodextrins which can be used by the cell.

Suitable nano-sized polysaccharide particles for use in emulsion aggregation toner particles may be synthesized as disclosed in the following papers: (1) Huebner et al., *Preparation of Cellodextrins: An Engineering Approach*, Biotechnology And Bioengineering, vol. 20, no. 10, pp. 1669-1677; (2) Zhang et al., *Cellodextrin Preparation by Mixed-Acid Hydrolysis and Chromatographic Separation*, Analytical Biochemistry, vol. 322, no. 2, pp. 225-232 (2003); and (3) Hiraishi et al., *Synthesis Of Highly Ordered Cellulose II In Vitro Using Cellodextrin Phosphorylase*, Carbohydrate Research, vol. 344, no. 18, pp. 2468-2473 (Dec. 14, 2009), the disclosures of which are hereby incorporated in their entirety by reference.

In some embodiments, suitable polysaccharides may be represented by the following formulas:

$$C_x(H_2O)_y$$

where x is an integer of from about 200 to about 2500, and y is an integer of from about 400 to about 5000; or $$(C_6H_{10}O_5)_n,$$

where n is an integer of from about 40 to about 3000.

The polysaccharide may have a molecular weight of from about 500 to 300,000, such as from about 500 to about 100,000, or from about 2000 to about 300,000.

Specific nano-sized partially de-polymerized polysaccharides include microcrystalline cellulose such as Avicel PH105, commercially available from FMC Corp.; Sancel, commercially available from NB Entrepreneurs; and Comprecel, commercially available from Parchem.

Microcrystalline cellulose is a purified, partially depolymerized polysaccharide or cellulose prepared by treating a polysaccharide or alpha-cellulose, obtained, for example, as a pulp or from fibrous plant material, with mineral acids. The degree of polymerization is typically less than 400. It is comprised of glucose units connected by a 1-4 beta glycosidic bond. These linear cellulose chains are bundled together as microfibril spiralled together in the walls of plant cell. Each microfibril exhibits a high degree of three-dimensional internal bonding resulting in a crystalline structure that is insoluble in water and resistant to reagents. There are, however, relatively weak segments of the microfibril with weaker internal bonding. These are sometimes referred to as amorphous regions, but are more accurately referred to as dislocations since microfibril containing single-phase structure. The crystalline region is isolated to produce microcrystalline cellulose.

The polysaccharide particles may be present in the toner in any effective amount, such as in amounts of from about 1 to about 50 wt % of the toner, such as from about 2 to about 40 wt %, from about 3 to about 30 wt %, from about 4 to about 20 wt %, from about 5 to about 10 wt %, from about 20 to about 30 wt %, from about 15 to about 20 wt %, or from about 6 to about 9 wt %.

Surfactants

One, two, or more surfactants may be used to form emulsions by contacting the resin, polysaccharide, and/or other components with one or more surfactants. The surfactants may be selected from ionic surfactants and nonionic surfactants. Anionic surfactants and cationic surfactants are encompassed by the term "ionic surfactants." The surfactant may be present in an amount of from about 0.01 to about 5 wt % of the toner composition, such as from about 0.75 to about 4 wt %, or from about 1 to about 3 wt %.

Examples of nonionic surfactants include, for example, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly (ethyleneoxy)ethanol, available from Rhone-Poulenac as IGEPAL CA-210™, IGEPAL CA520™, IGEPAL CA720™, IGEPAL CO-890™, IGEPAL CO-720™, IGEPAL CO-290™, IGEPAL CA-210™, ANTAROX 890™, and ANTAROX 597™. Other examples include a block copolymer of polyethylene oxide and polypropylene oxide, including those commercially available as SYNPERONIC PE/F, such as SYNPERONIC PE/F 108.

Suitable anionic surfactants include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid available from Aldrich, NEOGEN R™, NEOGEN SC™ obtained from Daiichi Kogyo Seiyaku, combinations thereof, and the like. Other suitable anionic surfactants include, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be used.

Examples of suitable cationic surfactants, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof.

Waxes

The emulsion aggregation toner particles may include one or more waxes. In these embodiments, the emulsion will include resin and wax particles at the desired loading levels, which allows for a single resin and wax emulsion to be made rather than separate resin and wax emulsions. The combined emulsion allows for reduction in the amount of surfactant needed to prepare separate emulsions for incorporation into toner compositions. This is particularly helpful in instances where it would otherwise be difficult to incorporate the wax into the emulsion. However, the wax may also be separately emulsified, such as with a resin, and separately incorporated into final products.

In addition to the polymer binder resin, the toners may also contain a wax, either a single type of wax or a mixture of two or more preferably different waxes. A single wax can be added to toner formulations, for example, to improve particular toner properties, such as toner particle shape, presence and amount of wax on the toner particle surface, charging and/or fusing characteristics, gloss, stripping, offset properties, and the like. Alternatively, a combination of waxes can be added to provide multiple properties to the toner composition.

Suitable examples of waxes include waxes selected from natural vegetable waxes, natural animal waxes, mineral waxes, synthetic waxes, and functionalized waxes. Examples of natural vegetable waxes include, for example, carnauba wax, candelilla wax, rice wax, sumacs wax, jojoba oil, Japan wax, and bayberry wax. Examples of natural animal waxes include, for example, beeswax, panic wax, lanolin, lac wax, shellac wax, and spermaceti wax. Mineral-based waxes include, for example, paraffin wax, microcrystalline wax, montan wax, ozokerite wax, ceresin wax, petrolatum wax, and petroleum wax. Synthetic waxes include, for example, Fischer-Tropsch wax; acrylate wax; fatty acid amide wax; silicone wax; polytetrafluoroethylene wax; polyethylene wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate; and cholesterol higher fatty acid ester waxes, such as cholesteryl stearate; polypropylene wax; and mixtures thereof.

In some embodiments, the wax may be selected from polypropylenes and polyethylenes commercially available from Allied Chemical and Baker Petrolite (for example POLYWAX™ polyethylene waxes from Baker Petrolite), wax emulsions available from Michelman Inc. and the Daniels Products Company, EPOLENE N-15 commercially available from Eastman Chemical Products, Inc., VISCOL 550-P, a low weight average molecular weight polypropylene available from Sanyo Kasei K.K., and similar materials. The commercially available polyethylenes usually possess a molecular weight Mw of from about 500 to about 2,000, such as from about 1,000 to about 1,500, while the commercially available polypropylenes have a molecular weight of about 1,000 to about 10,000. Examples of functionalized waxes include amines, amides, imides, esters, quaternary amines, carboxylic acids, or acrylic polymer emulsion, for example, JONCRYL 74, 89, 130, 537, and 538, all available from Johnson Diversey, Inc., chlorinated polypropylenes, and polyethylenes commercially available from Allied Chemical and Petrolite Corporation and Johnson Diversey, Inc. The polyethylene and polypropylene compositions may be selected from those illustrated in British Pat. No. 1,442,835, the entire disclosure of which is incorporated herein by reference.

The toners may contain the wax in any amount of from, for example, about 1 to about 25 wt % of toner, such as from about 3 to about 15 wt % of the toner, on a dry basis; or from about 5 to about 20 wt % of the toner, such as from about 5 to about 11 wt % of the toner.

Colorants

The emulsion aggregation toner particles may also include at least one colorant. For example, colorants or pigments as used herein include pigment, dye, mixtures of pigment and dye, mixtures of pigments, mixtures of dyes, and the like. For simplicity, the term "colorant" as used herein is meant to encompass such colorants, dyes, pigments, and mixtures, unless specified as a particular pigment or other colorant component. The colorant may comprise a pigment, a dye, mixtures thereof, carbon black, magnetite, black, cyan, magenta, yellow, red, green, blue, brown, mixtures thereof, in an amount of about 0.1 to about 35 wt % based upon the total weight of the composition, such as from about 1 to about 25 wt %. It is to be understood that other useful colorants will become readily apparent based on the present disclosures.

In general, useful colorants include Paliogen Violet 5100 and 5890 (BASF), Normandy Magenta RD-2400 (Paul Uhlrich), Permanent Violet VT2645 (Paul Uhlrich), Heliogen Green L8730 (BASF), Argyle Green XP-111-S (Paul Uhlrich), Brilliant Green Toner GR 0991 (Paul Uhlrich), Lithol Scarlet D3700 (BASF), Toluidine Red (Aldrich), Scarlet for Thermoplast NSD Red (Aldrich), Lithol Rubine Toner (Paul Uhlrich), Lithol Scarlet 4440, NBD 3700 (BASF), Bon Red C (Dominion Color), Royal Brilliant Red RD-8192 (Paul Uhlrich), Oracet Pink RF (Ciba Geigy), Paliogen Red 3340 and 3871K (BASF), Lithol Fast Scarlet L4300 (BASF), Heliogen Blue D6840, D7080, K7090, K6910 and L7020 (BASF), Sudan Blue OS (BASF), Neopen Blue FF4012 (BASF), PV Fast Blue B2G01 (American Hoechst), Irgalite Blue BCA (Ciba Geigy), Paliogen Blue 6470 (BASF), Sudan II, III and IV (Matheson, Coleman, Bell), Sudan Orange (Aldrich), Sudan Orange 220 (BASF), Paliogen Orange 3040 (BASF), Ortho Orange OR 2673 (Paul Uhlrich), Paliogen Yellow 152 and 1560 (BASF), Lithol Fast Yellow 0991K (BASF), Paliotol Yellow 1840 (BASF), Novaperm Yellow FGL (Hoechst), Permanerit Yellow YE 0305 (Paul Uhlrich), Lumogen Yellow D0790 (BASF), Suco-Gelb 1250 (BASF), Suco-Yellow D1355 (BASF), Suco Fast Yellow D1165, D1355 and D1351 (BASF), Hostaperm Pink E (Hoechst), Fanal Pink D4830 (BASF), Cinquasia Magenta (DuPont), Paliogen Black L9984 9BASF), Pigment Black K801 (BASF) and particularly carbon blacks such as REGAL 330 (Cabot), Carbon Black 5250 and 5750 (Columbian Chemicals), and the like, and mixtures thereof Additional useful colorants include pigments in water based dispersions such as those commercially available from Sun Chemical, for example SUNSPERSE BHD 6011X (Blue 15 Type), SUNSPERSE BHD 9312X (Pigment Blue 15 74160), SUNSPERSE BHD 6000X (Pigment Blue 15:3 74160), SUNSPERSE GHD 9600X and GHD 6004X (Pigment Green 7 74260), SUNSPERSE QHD 6040X (Pigment Red 122 73915), SUNSPERSE RHD 9668X (Pigment Red 185 12516), SUNSPERSE RHD 9365X and 9504X (Pigment Red 57 15850:1, SUNSPERSE YHD 6005X (Pigment Yellow 83 21108), FLEXIVERSE YFD 4249 (Pigment Yellow 17 21105), SUNSPERSE YHD 6020X and 6045X (Pigment Yellow 74 11741), SUNSPERSE YHD 600X and 9604X (Pigment Yellow 14 21095), FLEXIVERSE LFD 4343 and LFD 9736 (Pigment Black 7 77226) and the like, and mixtures thereof. Other useful water based colorant dispersions include those commercially available from Clariant, for example, HOSTAFINE Yellow GR, HOSTAFINE Black T and Black TS, HOSTAFINE Blue B2G, HOSTAFINE Rubine F6B and magenta dry pigment such as Toner Magenta 6BVP2213 and Toner Magenta EO2 which can be dispersed in water and/or surfactant prior to use.

Other useful colorants include, for example, magnetites, such as Mobay magnetites MO8029, MO8960; Columbian magnetites, MAPICO BLACKS and surface treated magnetites; Pfizer magnetites CB4799, CB5300, CB5600, MCX6369; Bayer magnetites, BAYFERROX 8600, 8610; Northern Pigments magnetites, NP-604, NP-608; Magnox magnetites TMB-100 or TIM-104; and the like or mixtures thereof. Specific additional examples of pigments include phthalocyanine HELIOGEN BLUE L6900, D6840, D7080, D7020, PYLAM OIL BLUE, PYLAM OIL YELLOW, PIGMENT BLUE 1 available from Paul Uhlrich & Company, Inc., PIGMENT VIOLET 1, PIGMENT RED 48, LEMON CHROME YELLOW DCC 1026, E.D. TOLUIDINE RED and BON RED C available from Dominion Color Corporation, Ltd., Toronto, Ontario, NOVAPERM YELLOW FGL, HOSTAPERM PINK E from Hoechst, and CINQUASIA MAGENTA available from E.I. DuPont de Nemours & Company, and the like. Examples of magentas include, for example, 2,9-dimethyl substituted quinacridone and anthraquinone dye identified in the Color Index as CI-60710, CI Dispersed Red 15, diazo dye identified in the Color Index as CI-26050, CI Solvent Red 19, and the like or mixtures thereof. Illustrative examples of cyans include copper tetra (octadecyl sulfonamide) phthalocyanine, x-copper phthalocyanine pigment listed in the Color Index as CI74160, CI Pigment Blue, and Anthrathrene Blue identified in the Color Index as DI 69810, Special Blue X-2137, and the like or mixtures thereof. Illustrative examples of yellows that may be selected include diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,4-dimethoxy acetoacetanilide, and Permanent Yellow FGL. Colored magnetites, such as mixtures of MAPICOBLACK and cyan components may also be selected as pigments.

The colorant, such as carbon black, cyan, magenta and/or yellow colorant, is incorporated in an amount sufficient to impart the desired color to the toner. In general, pigment or dye is employed in an amount ranging from about 1 to about 35 wt % of the toner particles on a solids basis, such as from about 5 to about 25 wt % or from about 5 to about 15 wt %. However, amounts outside these ranges can also be used.

Coagulants

The emulsion aggregation process for making toners of the present disclosure uses at least one coagulant, such as a monovalent metal coagulant, a divalent metal coagulant, a polyion coagulant, or the like. As used herein, "polyion coagulant" refers to a coagulant that is a salt or oxide, such as a metal salt or metal oxide, formed from a metal species having a valence of at least 3, at least 4 or at least 5. Suitable coagulants include, for example, coagulants based on aluminum such as polyaluminum halides such as polyaluminum fluoride and polyaluminum chloride (PAC), polyaluminum silicates such as polyaluminum sulfosilicate (PASS), polyaluminum hydroxide, polyaluminum phosphate, aluminum sulfate, and the like. Other suitable coagulants include tetraalkyl titinates, dialkyltin oxide, tetraalkyltin oxide hydroxide, dialkyltin oxide hydroxide, aluminum alkoxides, alkylzinc, dialkyl zinc, zinc oxides, stannous oxide, dibutyltin oxide, dibutyltin oxide hydroxide, tetraalkyl tin, and the like. Where the coagulant is a polyion coagulant, the coagulants may have any desired number of polyion atoms present. For example, suitable polyaluminum compounds include those having from about 2 to about 13, such as from about 3 to about 8, aluminum ions present in the compound Such coagulants can be incorporated into the toner particles during particle aggregation. As such, the coagulant can be present in the toner particles, exclusive of external additives and on a dry weight basis, in amounts of from 0 to about 5 wt % of the toner particles, such as from about greater than 0 to about 3 wt % of the toner particles.

Emulsion Aggregation Processes

Any suitable emulsion aggregation process may be used and modified in forming the emulsion aggregation toner particles without restriction. Such emulsion aggregation processes generally include the steps of emulsifying, aggregating, coalescencing, washing, and drying. United States patent documents describing emulsion aggregation toners include, for example, U.S. Pat. Nos. 5,278,020; 5,290,654; 5,308,734; 5,344,738; 5,346,797; 5,348,832; 5,364,729; 5,366,841; 5,370,963; 5,403,693; 5,405,728; 5,418,108; 5,496,676; 5,501,935; 5,527,658; 5,585,215; 5,650,255; 5,650,256; 5,723,253; 5,744,520; 5,747,215; 5,763,133; 5,766,818; 5,804,349; 5,827,633; 5,840,462; 5,853,944; 5,863,698; 5,869,215; 5,902,710; 5,910,387; 5,916,725; 5,919,595; 5,925,488; 5,977,210; 6,576,389; 6,617,092; 6,627,373; 6,638,677; 6,656,657; 6,656,658; 6,664,017; 6,673,505; 6,730,450; 6,743,559; 6,756,176; 6,780,500; 6,830,860; and 7,029,817; and U.S. Patent Application Publication No. 2008/0107989 the entire disclosures of which are also incorporated herein by reference. These procedures may be modified to facilitate the inclusion of a polysaccharide to increase the bio-content of the toner particles. Thus, the emulsion aggregation process includes the basic process steps of aggregating an emulsion containing a polymer binder, a polysaccharide, an optional wax, an optional colorant, a surfactant, and an optional coagulant to form aggregated particles; freezing the growth of the aggregated particles; coalescing the aggregated particles to form coalesced particles; and then isolating, optionally washing, and optionally drying the toner particles.

Emulsion Formation. If the resin and polysaccharide have solubility parameters that are similar, the same solvent may be used to dissolve the resin and polysaccharide to produce a homogeneous solution. The resin and polysaccharide may be emulsified together. However, when the resin and polysaccharide emulsions are not prepared together, the resin may be added to a prepared polysaccharide emulsion, the polysaccharide may be added to a prepared resin emulsion, or a prepared polysaccharide emulsion may be added to a prepared resin emulsion. The emulsions may be emulsified mechanically or chemically.

For example, phase inversion emulsification (PIE) may be used where both the polysaccharide and the resin are dissolved in a suitable solvent. Water may be added to the solvent until separation of the solvent and water occurs under mixing. The solvent may be removed by vacuum distillation and an emulsion of polymer and polysaccharide micro-spheres in water results. For a description of PIE process see U.S. Pat. No. 7,029,817; U.S. Patent Application Publication No. 2006/0223934; and U.S. Patent Application Publication No. 2008/0236446, the entire disclosures of which are incorporated herein by reference.

The emulsion may be prepared by dissolving a resin and/or polysaccharide in a solvent. Suitable solvents include alcohols, ketones, esters, ethers, chlorinated solvents, nitrogen containing solvents, and mixtures thereof. Specific examples of suitable solvents include dichloromethane, isopropyl alcohol, acetone, methyl acetate, methyl ethyl ketone, tetrahydrofuran, cyclohexanone, ethyl acetate, N,N dimethylformamide, dioctyl phthalate, toluene, xylene, benzene, dimethylsulfoxide, and mixtures thereof. The resin/polysaccharide may be dissolved in a solvent at an elevated temperature of from about 20° C. to about 80° C., such as from about 20° C. to about 70° C., The resin/polysaccharide is dissolved at a temperature below the boiling point of the solvent, such as from about 2° C. to about 15° C., or from about 5° C. to about 10° C. below the boiling point of the solvent, and at a temperature lower than the glass-transition temperature of the resin/polysaccharide.

After being dissolved in a solvent, the dissolved resin/polysaccharide may be mixed, for example by homogenization, into an emulsion medium, for example water, such as deionized water, containing an optional stabilizer and an optional surfactant.

Next, the mixture may be heated to flash off the solvent, and then cooled to room temperature. The solvent flashing may be conducted at any suitable temperature above the boiling point of the solvent in water that will flash off the solvent, such as from about 60° C. to about 100° C., from about 70° C. to about 90° C., or about 80° C., although the temperature may be adjusted. Solvent flashing is typically performed under vacuum to increase the solvent stripping rate. An optional defoamer may be added to decrease foam generation during solvent stripping Following the solvent flash step, the resin/polysaccharide emulsion may have an average particle diameter in the range of from about 100 nm to about 500 nm, such as from about 130 nm to about 300 nm as measured with a Honeywell MICROTRAC® UPA150 particle size analyzer.

In an embodiment, an emulsion is prepared by agitating in water a mixture of one or more of an optional nonionic surfactant, such as polyethylene glycol or polyoxyethylene glycol nonyl phenyl ether, an optional anionic surfactant, such as sodium dodecyl sulfonate or sodium dodecyl benzenesulfonate, a resin, and/or a polysaccharide.

In another embodiment, an emulsion of polysaccharide is prepared by agitating in water a polysaccharide. The resin to water weight ratio is from 1:1 to 1:20, or from 1:3 to 1:10.

The resulting emulsion sized resin/polysaccharide particles may have a volume average diameter of from about 20 nm to about 1200 nm specifically including all sub-ranges and individual values within the range of about 20 nm to about 1200 nm. The resulting emulsion, which typically contains from about 20% to about 60% solids, may be diluted with water to about 15% solids. A polysaccharide or resin may be added at this point to the emulsion if such a component has not been previously added or if additional resins or polysaccharides are desirable that were not included in the above formed emulsion processes.

Additional optional additives, such as additional surfactants, colorants, waxes, and coagulants, may be added to the emulsion.

Aggregation. The resin-polysaccharide-optional additive mixture is then homogenized, for example, at from about 2000 to about 6000 rpm, to form statically bound pre-aggregated particles. The statically bound pre-aggregated particles are then heated to an aggregation temperature that is below the glass-transition temperature of the resin to form aggregated particles. For example, the pre-aggregated particles may be heated to an aggregation temperature of from about 40° C. to about 60° C., such as from about 30° C. to about 50° C. or from about 35° C. to about 45° C. The particles may be maintained at the aggregation temperature for a duration of time of, for example, from about 30 minutes to about 600 minutes, such as from about 60 minutes to about 400 minutes, or from about 200 minutes to about 300 minutes.

At this point, the particle size and distribution is "frozen" by pH adjustment, and is optionally coalesced to form polymeric toner particles of a controlled size with narrow size distribution.

Optionally, a shell may be added to the core by conventional methods prior to coalescence.

Coalescence. After freezing the growth of the aggregated particles at the desired size, the aggregated particles may optionally again be heated to a coalescence temperature at or above the glass-transition temperature of the resin to coalesce the aggregated particles into coalesced particles. For example, the aggregated particles may be heated to a coalescence temperature of from about 60° C. to about 100° C., such as from about 70° C. to about 90° C., or from about 75° C. to about 85° C. The particles may be maintained at the coalescence temperature for a duration of time of, for example, about 30 minutes to about 600 minutes, such as from about 60 minutes to about 400 minutes, or from about 200 minutes to about 300 minutes.

Once the toner particles are formed, they may be isolated from the reaction mixture by any suitable means. Suitable isolation methods include filtration, particle classification, and the like.

The formed toner particles may optionally be washed, dried, and/or classified by any known conventional means. For example, the formed toner particles can be washed using, for example, water, deionized water, or other suitable materials. The formed toner particles may likewise be dried using, for example, a heated drying oven, a spray dryer, a flash dryer, pan dryer freeze dryer, or the like.

Following the optional particle classification, washing and/or drying, the polymeric particles may be subjected to an optional chemical surface treatment. For example, the polymeric particles may be subjected to any desirable surface treatment to alter the chemical and/or physical properties of the particle, such as hydrophobicity, hydrophilicity, surface charge, and the like, or to attach or alter functional groups present on the surface of the particles.

The toner emulsion aggregation particles may be made to have a small size (VolD50), for example, from about 3 μm to about 10 μm, from about 4 μm to about 9 μm, or about 4 μm to 8.5 μm.

Due to the emulsion aggregation process, the toner particles have an excellent particle size distribution, particularly compared to the scattered distribution typically exhibited from polymeric particles prepared by grinding techniques. The toner particles may have an upper geometric standard deviation by volume ($GSD_V$) in the range of from about 1.15 to about 1.30, such as about 1.18 to about 1.23; and a lower geometric standard deviation by number ($GSD_N$) in the range of from about 1.20 to about 1.40, such as about 1.20 to about 1.30, These GSD values indicate that the particles have a very narrow particle size distribution. The upper GSD is calculated from the cumulative volume percent finer than measurement and is the ratio of the 84% finer than (D84v) by volume to the 50% finer than (D50v) by volume; it is often notated D84/50v. The lower GSD is calculated from the number percent finer than measurement and is the ratio of the 50% finer than (D50n) by number to the 16% finer than (D16n) by number; it is often notated as D50/16n.

In addition, emulsion aggregation particles can have specific shapes depending on the process conditions, which can be important parameters in various end-product uses. Thus, the particle shape may also be controlled. The particles may have a shape factor of about 105 to about 170, such as about 110 to about 160, SF1*a. Scanning electron microscopy (SEM) is used to determine the shape factor analysis of the particles by SEM and image analysis (IA) is tested. The average particle shapes are quantified by employing the following shape factor (SF1*a) formula: $SF1*a=100\pi d^2/(4A)$, where A is the area of the particle and d is its major axis. A perfectly circular or spherical particle has a shape factor of exactly 100. The shape factor SF1*a increases as the shape becomes more irregular or elongated in shape with a higher surface area.

In addition to measuring shape factor, another metric to measure particle circularity uses an FPIA-2100 or FPIA 3000, manufactured by Sysmex. This method more quickly quantifies the particle shape. A completely circular sphere has a circularity of 1.000. In some embodiments, the particles have a circularity of about 0.920 to 0.990, such as from about 0.950 to about 0.985.

When printed, the toner particles containing polysaccharide have excellent crease minimum fusing temperatures of from about 140° C. to about 200° C., such as about 145° C. to about 155° C., or about 150° C.

When printed, the toner particles containing polysaccharide also have a high gloss, as opposed to a matte image. For example, such toners when printed have a gloss of from about 10 to about 90 Gardner Gloss Units (ggu), such as from about 30 to about 90 ggu, or from about 40 to about 80 ggu.

The toner may have a relative humidity sensitivity of, for example, from about 0.5 to about 10, such as from about 0.5 to about 5. Relative humidity (RH) sensitivity is a ratio of the charging of the toner at high humidity conditions to charging at low humidity conditions. That is, the RH sensitivity is defined as the ratio of toner charge at 15% relative humidity and a temperature of about 12° C. (denoted herein as C-zone) to toner charge at 85% relative humidity and a temperature of about 28° C. (denoted herein as A-zone); thus, RH sensitivity is determined as (C-zone charge)/(A-zone charge). Ideally, the RH sensitivity of a toner is as close to 1 as possible, indicating that the toner charging performance is the same in low and high humidity conditions, that is, that the toner charging performance is unaffected by the relative humidity.

Toners prepared in accordance with the present disclosure possess improved charging performance, with Q/m (Toner charge per mass ratio) in A- and C-zone of from about −3 to about −60 microcoulombs per gram, such as from about −4 to about −50 microcoulombs per gram.

EXAMPLES

Example 1

Preparation of Polysaccharide Emulsion

In to a 200 ml glass beaker, 11 grams of microcrystalline cellulose (Avicel PH105), and 150 grams deionized water are mixed. The mixture is stirred on a hotplate using a magnetic stir bar at 250 rpm at room temperature for about 20 hours. The resulting emulsion comprises about 7.85% by weight solids in water and has an average particle size of 50.1 nm.

Example 2

Preparation of Toner Containing 10 Wt % Polysaccharide 152.87 g of the polysaccharide emulsion of Example 1 and 199.25 g of an amorphous resin comprising terpoly-(propoxylated bisphenol A-fumarate)-terpoly(propoxylated bisphenol A-terephthalate)-terpoly-(propoxylated bisphenol A-2-dodecylsuccinate) (37.34 wt %) are added into a 2 L glass reactor, equipped with an overhead stirrer and heating mantle. The mixture is homogenized, and 59.84 g of $Al_2(SO_4)_3$ solution (1 wt %) is added as a flocculent during homogenization. The mixture is subsequently heated to 33.8° C. for aggregation at 300 rpm. The particle size is monitored with a Coulter Counter until the core particles reached a volume average particle size of 4.59 μm with a GSDv of 1.22. Then, a shell is formed by adding 44.99 g of the same amorphous resin used above, resulting in core-shell structured particles with an average particle size of 5.54 μm and a GSDv of 1.19. Thereafter, the pH of the reaction slurry is increased to 7.88 using 4.62 g EDTA (39 wt %) and NaOH (4 wt %) to freeze the toner growth. After freezing, the reaction mixture is heated to 85.2° C. and the pH was reduced to 6.5 for coalescence. After coalescence, the toner is quenched. Finally the toner slurry is cooled to room temperature, separated by sieving filtration (25 μm), washed, and freeze dried.

In this example, 10% polysaccharide is used instead of 10% amorphous polyester resin as is used in, for example, U.S. Pat. No. 7,235,337. In addition, no pigment is added to the toner formulation so that the polysaccharide domain could be determined by TEM without confounding.

Results.

Figure 2A:
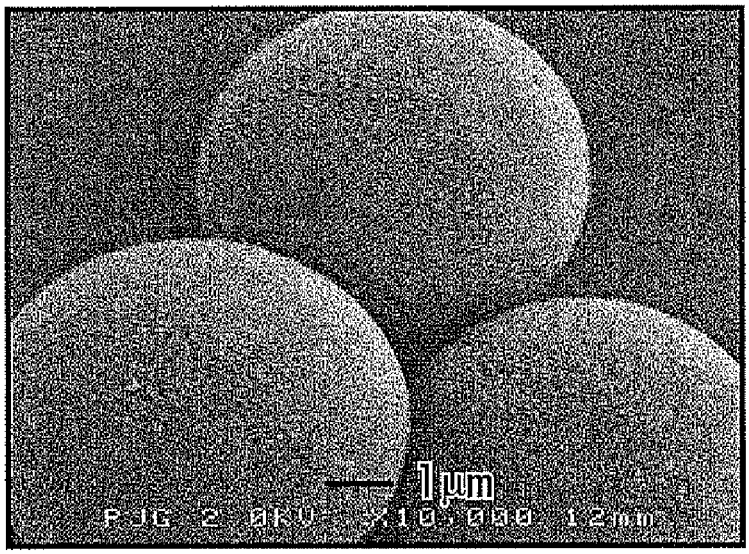
FIGS. 2(*a*) and 2(*b*) are scanning electron microscopy (SEM) images of toner particles containing polysaccharide.
Figure 2B:
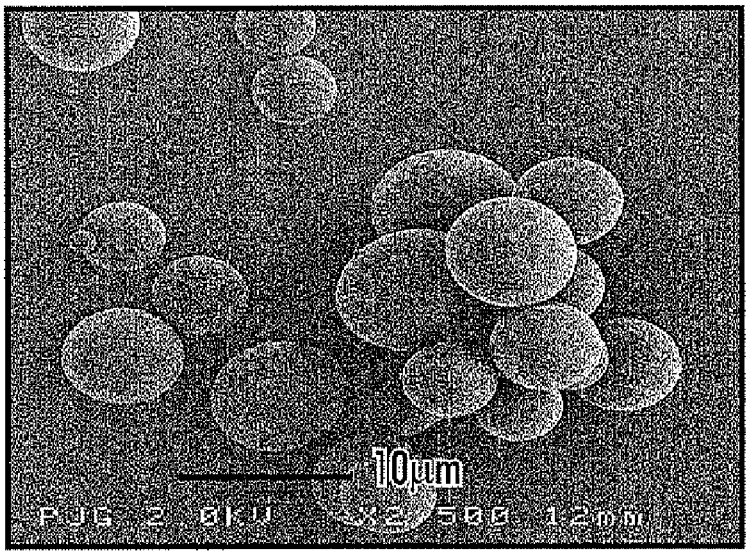
Figure 3A:
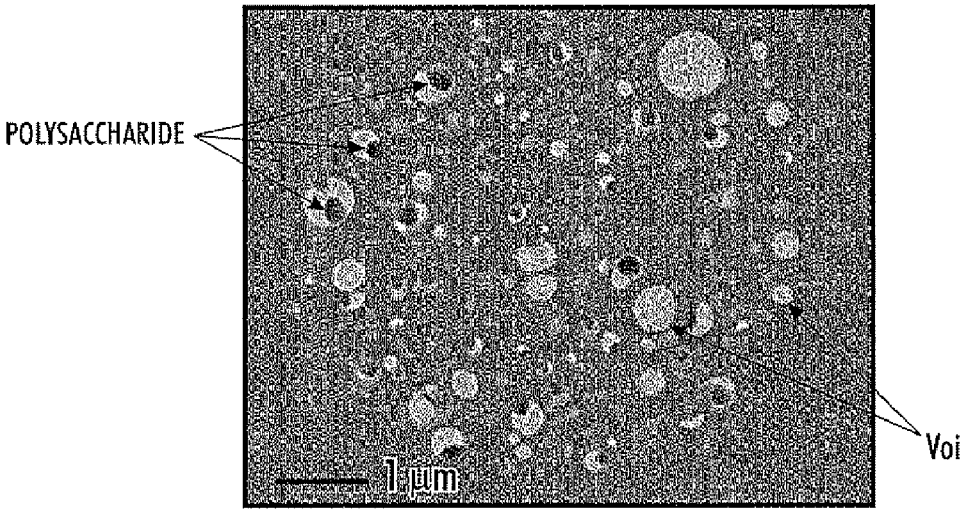
FIGS. 3(*a*) and 3(*b*) are transmission electron microscopy (TEM) images illustrating domain size and distribution of polysaccharide in toner particles containing polysaccharide.
Figure 3B:
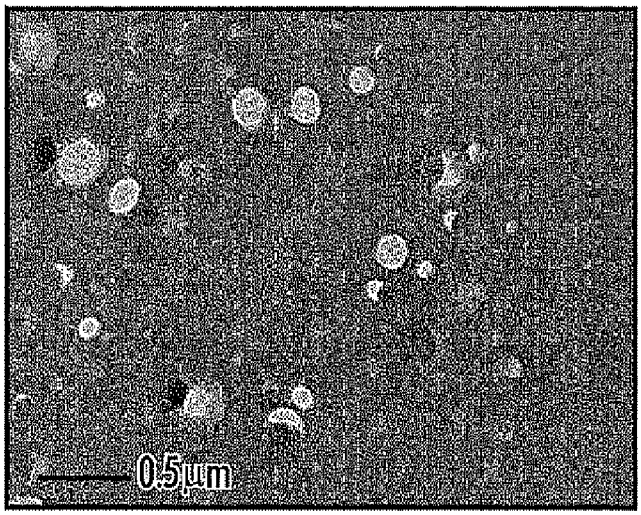

The final toner particles have a final particle size of 5.71 μm, a GSD of 1.23, and a circularity of 0.974. By SEM and TEM, the final toner particles are found to contain polysaccharide domains well distributed throughout the interior of the particles and a size range of about 0.2-0.5 μm. See FIGS. 2 and 3.

The charging/blocking and fusing of the toner particles of Example 2 are evaluated. The charging and blocking are found to be good and excellent. For example, Table 1 (below) illustrates that the tribo Q/m for Example 2 is very similar to that of a control emulsion aggregation control toner, which does not contain polysaccharide. In addition, the blocking of toner is excellent at 10% at 54° C.

TABLE 1

| | Toner of Example 2 | Control Toner |
|---|---|---|
| A zone 60' Q/m | 34 | 40 |
| C zone 60' Q/m | 63 | 66 |
| Blocking @ 54° C. | 10% | 66% |

Initial fusing evaluation is carried out using an iGen3 fusing fixture. Standard operating procedures are followed where unfused images of (1) the toner of Example 2, (2) a first control toner (iGen3 Cyan Series 9, commercially available from Xerox Corp.), and (3) a second control toner (PP-C33 commercially available from Xerox Corp.) are developed onto DCX+ 90 gsm and DCEG 120 gsm paper (both commercially available from Xerox Corp.). The toner mass per unit area for the unfused images is 0.5 mg/cm2. Both control toners as well as the test toner are fused over a wide range of temperatures. Cold offset, gloss, crease fix, and document offset performance are measured.

The toner of Example 2 produces a glossy toner having a higher peak gloss than the control toners as depicted in FIG. 1. Thus, adding polysaccharide does not result in a matte image. Instead, the addition of polysaccharide surprisingly results in a glossy finish, above the gloss of the conventional control toners.

The toner of Example 2 cold offsets at 140° C. (DCX+) and 150° C. (DCEG). Because the toner of Example 2 does not contain pigment, image analysis of the creased samples cannot be carried out. However, a visual determination of crease minimum fusing temperature (MFT) determined that its MFT was 145° C. and 155° C. respectively for the two papers, similar to what is found with PP-C33.

SEM, TEM, Charging and Blocking, and Fusing results indicate that a bio-based material, polysaccharide is incorporated in the emulsion aggregation toner successfully without negative effect on toner properties. Based on the above results, higher levels of polysaccharides can also be added to the emulsion aggregation toner, such as amounts of from about 15 wt % to about 50 wt %, or about 20 wt %.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. Emulsion aggregation toner particles, comprising:
- a resin,
- polysaccharide particles,
- an optional colorant, and
- an optional wax;
- wherein the polysaccharide particles comprises 1 to 50 wt % of the toner particles.

2. The toner particles of claim 1, wherein the resin comprises a polyester amorphous resin.

3. The toner particles of claim 2, wherein the resin further comprises a crystalline polyester resin.

4. The toner particles of claim 1, wherein the resin comprises a first amorphous resin, a second amorphous resin different than said first amorphous resin, and a crystalline resin.

5. The toner particles of claim 1, wherein the polysaccharide particles have an average particle size of from about 10 nm to about 200 nm.

6. The toner particles of claim 5, wherein the polysaccharide is selected from the group consisting of starch, cellulose, chitin, glycogen, cellodextrins, partially de-polymerized polysaccharide, microcrystalline cellulose, and combinations thereof.

7. The toner particles of claim 5, wherein the toner particles have a GSD of less than or equal to about 1.30.

8. The toner particles of claim 5, wherein the average toner particle size is about 3.5 μm to about 9 μm.

9. The toner particles of claim 5, wherein the circularity of the toner particles is from about 0.950 to about 0.980.

10. The toner particles of claim 5, wherein the toner particles have a crease MFT of 140° C. to 200° C. when printed.

11. The toner particles of claim 5, wherein the toner particles have a gloss of 20 to 80 ggu when printed.

12. The toner particles of claim 5, wherein the toner particles have a parent toner charge per mass ratio of from about −3 μC/g to about −60 μC/g.

13. A method of making toner particles, the method comprising:
- combining a resin emulsion, a polysaccharide emulsion, an optional colorant, and an optional wax to form pre-aggregated particles;
- aggregating the pre-aggregated particles to form aggregated particles;
- coalescing the aggregated particles to form coalesced particles; and
- isolating the coalesced particles to form toner particles.

14. The method of claim 13, wherein the polysaccharide particles have an average particle size of from about 10 nm to about 200 nm.

15. The method of claim 14, wherein the polysaccharide comprises 1 to 50 wt % of the toner particles.

16. The method of claim 14, wherein the polysaccharide is selected from the group consisting of starch, cellulose, chitin, glycogen, cellodextrins, partially de-polymerized polysaccharide, microcrystalline cellulose, and combinations thereof.

17. The method of claim 14, wherein the average toner particle size is about 3.5 μm to about 9 μm.

18. The method of claim 13, wherein the polysaccharide emulsion is formed by agitating a polysaccharide in water.

19. The method of claim 13, wherein the polysaccharide emulsion is formed by:
- dissolving an amorphous resin and polysaccharide particles in an organic solvent to form an organic solution,
- preparing an aqueous solution comprising an optional neutralization agent, and an optional surfactant;
- combining the organic solution and the aqueous solution to form a mixture, and homogenizing the mixture; and
- removing the organic solvent by heating the mixture to about a temperature above a boiling point of the solvent but below a boiling point of water.

20. The method of claim 19, wherein the solvent is selected from the group consisting of alcohols, ketones, esters, ethers, chlorinated solvents, nitrogen containing solvents, and mixtures thereof.

* * * * *